US005372402A

United States Patent [19]

Kuo

[11] Patent Number: 5,372,402

[45] Date of Patent: Dec. 13, 1994

[54] AIR COOLED CUSHION

[76] Inventor: Hung-Chou Kuo, Minghwa 1 Rd., Kaohsiung

[21] Appl. No.: 160,421

[22] Filed: Dec. 9, 1993

[51] Int. Cl.[5] ..... A47G 7/72

[52] U.S. Cl. ..... 297/180.13; 297/180.11

[58] Field of Search ..... 297/180.13, 180.14, 297/180.11, 180.1; 5/421, 423, 467, 468, 469

[56] References Cited

U.S. PATENT DOCUMENTS

| | | | |
|---|---|---|---|
| 1,475,912 | 11/1923 | Williams | 297/180.1 X |
| 4,946,220 | 8/1990 | Wyon et al. | 297/180.13 |

FOREIGN PATENT DOCUMENTS

| | | | |
|---|---|---|---|
| 206152 | 12/1986 | European Pat. Off. | 297/180.11 |
| 2137873 | 10/1984 | United Kingdom | 297/180.14 |
| 1567176 | 5/1990 | U.S.S.R. | 297/180.13 |

*Primary Examiner*—Laurie K. Cranmer
*Attorney, Agent, or Firm*—Alfred Lei

[57] ABSTRACT

An air cooled cushion comprising: a main tubular member including (a) a front tube having a side tube and a dovetail at one end; (b) a plurality of intermediate tubes each formed with a side tube, a dovetail groove at one end and a dovetail groove and another end, the dovetail of one of said intermediate tubes being rotatably engaged with the dovetail groove of adjacent one of said intermediate tubes thereby forming an elongated tubular member with a dovetail at one end and a dovetail groove at another end, the dovetail groove of said elongated tubular member being engaged with the dovetail of said front tube; (c) a rear tube having a side tube and a dovetail groove at one end, the dovetail groove of said rear tube being engaged with the dovetail of said elongated tubular member; (d) a cover engaged with said rear tube; (e) a branch tube engaged with the side tube of each of said front tube, said intermediate tubes and said rear tube thereby forming a backrest and a seat; an upper horizontal tube having a plurality of perforations and engaged with upper end of said backrest; a lower horizontal tube having a plurality of perforations and engaged with lower end of said seat; and an electric air blower connected with said front tube.

1 Claim, 5 Drawing Sheets

AIR COOLED CUSHION

BACKGROUND OF THE INVENTION

It has been found that the prior art cushion is simply made of foamed material and cannot cause air to move freely through thereby making the user sweat even in cool days.

Therefore, it is an object of the present invention to provide an improved cushion which may obviate and mitigate the above-mentioned drawbacks.

SUMMARY OF THE INVENTION

This invention relates to an air cooled cushion.

It is the primary object of the present invention to provide an air cooled cushion which utilizes air current to cool the cushion.

It is another object of the present invention to provide an air cooled cushion which may make the user feel more comfortable.

It is still another object of the present invention to provide an air cooled cushion which is simple in construction.

It is still another object of the present invention to provide an air cooled cushion which is easy to manufacture.

It is a further object of the present invention to provide an air cooled cushion which is economic to produce.

The invention accordingly consists of features of constructions and method, combination of elements, arrangement of parts and steps of the method which will be exemplified in the constructions and method hereinafter disclosed, the scope of the application of which will be indicated in the claim following.

DETAILED DESCRIPTION OF THE PREFERRED EMBODIMENT

Figure 1:
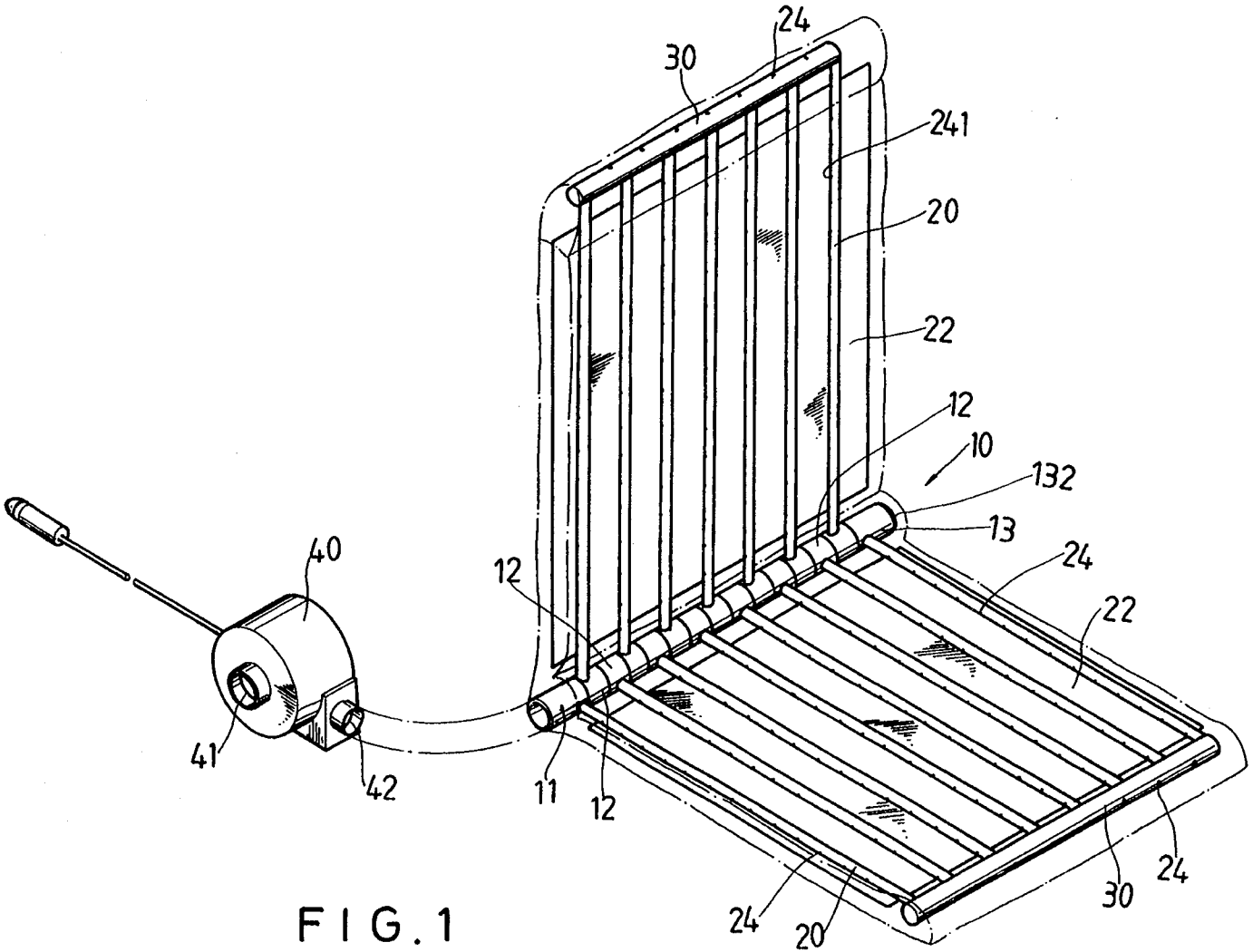
FIG. 1 is a perspective view of the present invention.

For purpose of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
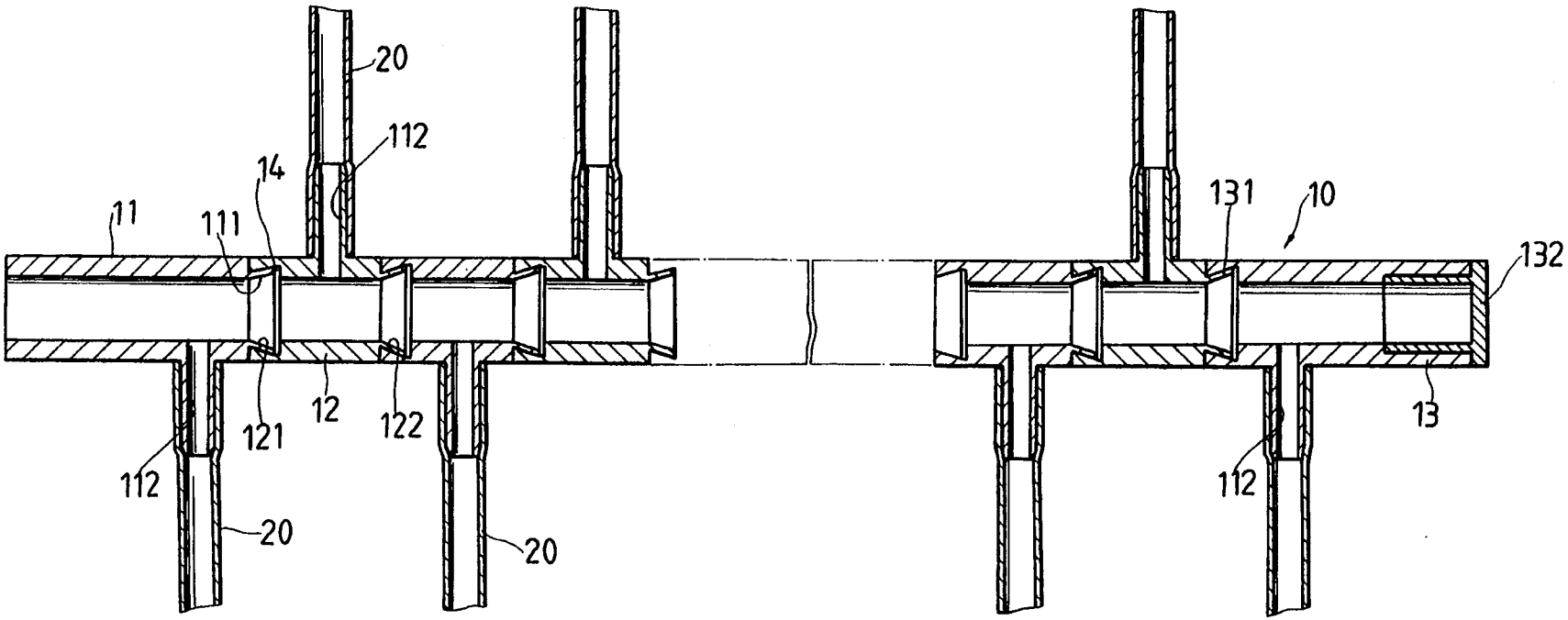
FIG. 2 is sectional view of the present invention.
Figure 3:
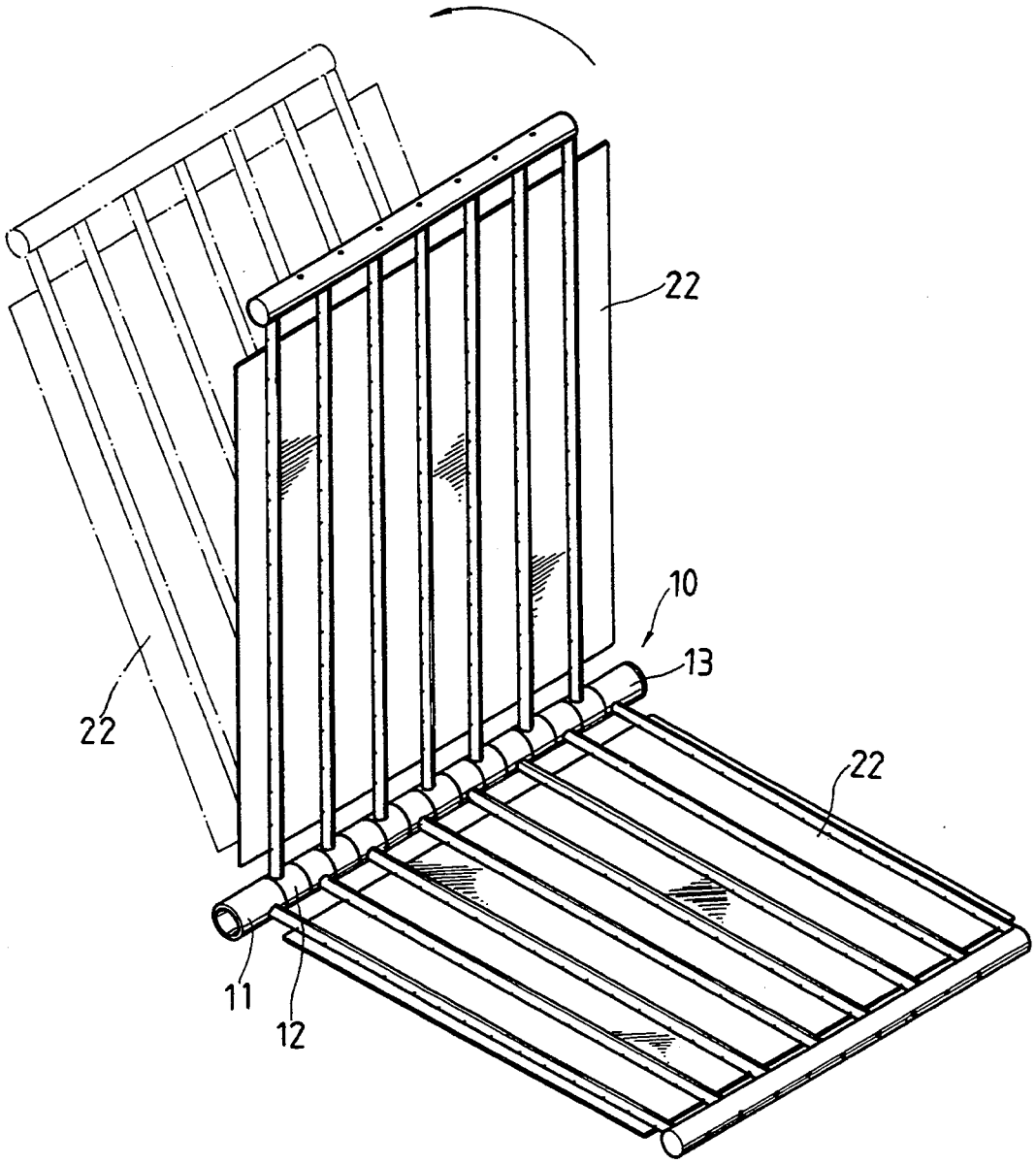
FIG. 3 is a working view of the present invention.

With reference to the drawings and in particular to FIGS. 1 and 2 thereof, the air cooled cushion according to the present invention comprises a main tubular member 10 which includes a front tube 11, a plurality of intermediate tubes 12, and a rear tube 13. Each of the front tube 11, the intermediate tubes 12 and the rear tube 13 is provided with a side tube 112. The side tube 112 is connected with a branch tube 20 having a plurality of perforations 241 thereby forming a seat and a backrest each of which is enclosed with a soft pad 22. The right end of the front tube 11 has a dovetail 111 which is rotatably engaged with a dovetail groove 121 of the leftmost intermediate tube 12 (with respect to FIG. 2). A packing 14 is disposed between the dovetail 111 of the front tube 11 and the dovetail groove 121 of the leftmost intermediate tube 12. Each of the intermediate tube 12 is formed with a dovetail 122 at one end and a dovetail groove 121 at the other end. The dovetail 122 of an intermediate tube 12 is rotatably engaged with the dovetail groove 121 of another intermediate tube 12. Also, there is a packing 14 disposed between the dovetail 122 of an intermediate tube 12 and the dovetail groove 121 of an adjacent intermediate tube 12. The dovetail 122 of the rightmost intermediate tube 12 is rotatably engaged with a dovetail groove 121 of the rear tube 13 and a packing 14 is disposed therebetween. The right end of the rear tube 13 is closed with a cover 132. The upper ends of the branch tubes 20 forming the backrest are connected with an upper horizontal tube 30 which is formed with a plurality of perforations 24, while the lower ends of the branch tubes 20 forming the seat are connected with a lower horizontal tube 30 which is formed with a plurality of perforations. The front tube 11 is connected with an air outlet 42 of an electric air blower 40 which will suck in air from an air inlet 41 and blow it out of the air outlet 42 into the main tubular member 10.

Figure 4:
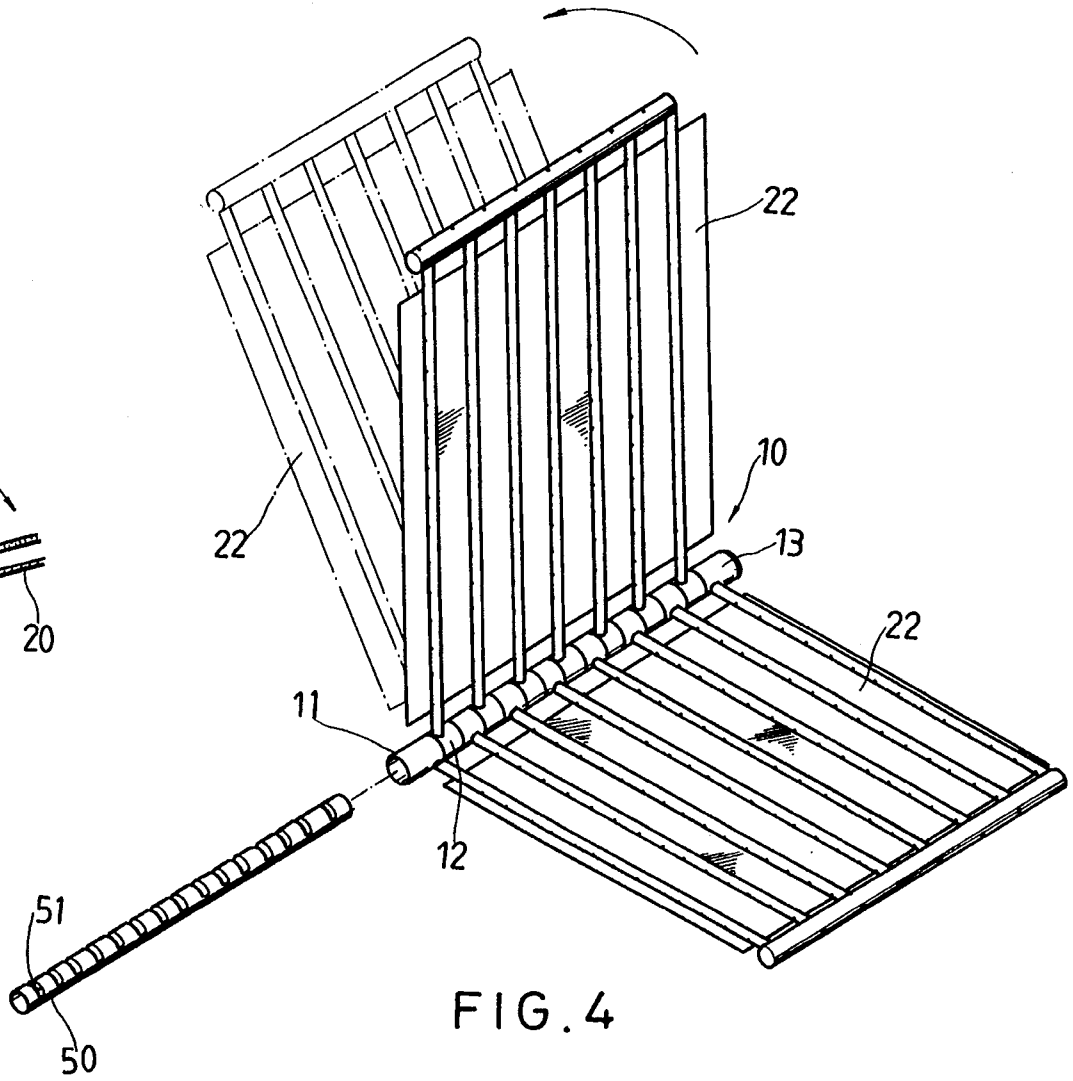
FIG. 4 shows a second preferred embodiment of the present invention.
Figure 5:
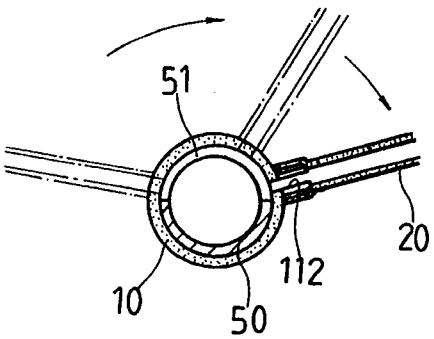
FIG. 5 is an enlarged fragmentary view of the second preferred embodiment.

FIGS. 4 and 5 show a second preferred embodiment of the present invention. As illustrated, a pipe 50 having a plurality of slots 51 is inserted into the main tubular member 10, with its slots 51 communicated with the side tubes 112 of the main tubular member 10 ( see FIGS. 4 and 5).

Figure 6:
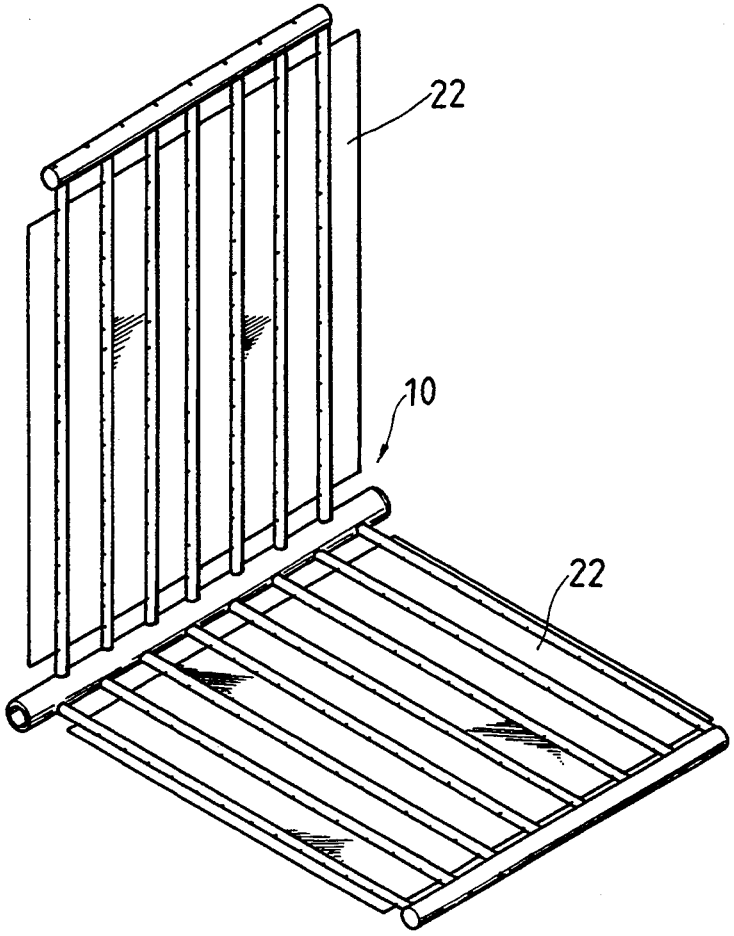
FIG. 6 shows a third preferred embodiment of the present invention.

FIG. 6 shows a third preferred embodiment of the present invention. As shown, the main tubular member 10 is an integral member connected with a plurality of branch tubes 20 forming a backrest and a seat making a right angle with the backrest.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. An air cooled cushion comprising: a main tubular member including:

(a) a front tube having a side tube and a dovetail at one end;

(b) a plurality of intermediate tubes each formed with a side tube, a dovetail groove at one end and a dovetail groove and another end, the dovetail of one of said intermediate tubes being rotatably engaged with the dovetail groove of adjacent one of said intermediate tubes thereby forming an elongated tubular member with a dovetail at one end and a dovetail groove at another end, the dovetail groove of said elongated tubular member being engaged with the dovetail of said front tube;

(c) a rear tube having a side tube and a dovetail groove at one end, the dovetail groove of said rear tube being engaged with the dovetail of said elongated tubular member;

(d) a cover engaged with said rear tube;

(e) a branch tube engaged with the side tube of each of said front tube, said intermediate tubes and said rear tube thereby forming a backrest and a seat;

an upper horizontal tube having a plurality of perforations and engaged with upper end of said backrest;

a lower horizontal tube having a plurality of perforations and engaged with lower end of said seat: and an electric air blower connected with said front tube.

* * * * *